US012600919B2

(12) United States Patent
Hamon et al.

(10) Patent No.: US 12,600,919 B2
(45) Date of Patent: Apr. 14, 2026

(54) LUBRICATING COMPOSITIONS

(71) Applicant: Syensqo Specialty Polymers USA, LLC, Alpharetta, GA (US)

(72) Inventors: Christine Hamon, Bollate (IT); Gaetano Calvaruso, Pforzheim (DE); Kelly D. Branham, Woodstock, GA (US); Hong Chen, Alpharetta, GA (US)

(73) Assignee: Syensqo Specialty Polymers USA, LLC, Alpharetta, GA (US)

( * ) Notice: Subject to any disclaimer, the term of this patent is extended or adjusted under 35 U.S.C. 154(b) by 0 days.

(21) Appl. No.: 18/707,509

(22) PCT Filed: Nov. 2, 2022

(86) PCT No.: PCT/EP2022/080493

§ 371 (c)(1),
(2) Date: May 3, 2024

(87) PCT Pub. No.: WO2023/078890

PCT Pub. Date: May 11, 2023

(65) Prior Publication Data

US 2025/0034474 A1 Jan. 30, 2025

Related U.S. Application Data

(60) Provisional application No. 63/275,025, filed on Nov. 3, 2021.

(30) Foreign Application Priority Data

Nov. 18, 2021 (EP) ..... 21209038

(51) Int. Cl.

| | |
|---|---|
| ***C10M 171/06*** | (2006.01) |
| ***C10N 20/06*** | (2006.01) |
| ***C10N 30/00*** | (2006.01) |
| ***C10N 30/06*** | (2006.01) |

(52) U.S. Cl.

CPC .. *C10M 171/06* (2013.01); *C10M 2209/1016* (2013.01); *C10M 2209/1036* (2013.01); *C10M 2213/0606* (2013.01); *C10M 2221/04* (2013.01); *C10N 2020/06* (2013.01); *C10N 2030/06* (2013.01); *C10N 2030/40* (2020.05)

(58) Field of Classification Search

CPC ..... C10M 171/06; C10M 2209/1016; C10M 2209/1036; C10M 2213/0606; C10M 2221/04; C10N 2020/06; C10N 2030/06; C10N 2030/20304

See application file for complete search history.

(56) References Cited

U.S. PATENT DOCUMENTS

| | | | | |
|---|---|---|---|---|
| 2003/0008782 | A1* | 1/2003 | Endou | C10M 157/00 508/591 |
| 2004/0183230 | A1* | 9/2004 | Chen | C08L 77/00 264/331.19 |
| 2010/0222244 | A1* | 9/2010 | Maccone | C10M 151/04 508/582 |
| 2013/0065054 | A1* | 3/2013 | Ichinose | C08G 75/0281 528/388 |
| 2020/0332215 | A1* | 10/2020 | Sawaguchi | C10M 105/18 |

FOREIGN PATENT DOCUMENTS

| | | | | |
|---|---|---|---|---|
| WO | WO-2007082829 | A1 * | 7/2007 | C10M 145/22 |
| WO | 2015095362 | A1 | 6/2015 | |
| WO | 2015197857 | A1 | 12/2015 | |
| WO | 2016079243 | A1 | 5/2016 | |

OTHER PUBLICATIONS

International Search Report issued in International Application No. PCT/EP2022/080493 mailed on Dec. 16, 2022 (3 pages).
Written Opinion issued in International Application No. PCT/EP2022/080493 mailed on Dec. 16, 2022 (6 pages).
International Standard ISO 9277, "Determination of the specific surface area of solids by gas adsorption—BET method", 2010, p. 1-24.

* cited by examiner

*Primary Examiner* — James C Goloboy
(74) *Attorney, Agent, or Firm* — Osha Bergman Watanabe & Burton LLP

(57) ABSTRACT

The present patent application relates to the use of non fluorinated aromatic polymers as additives for fluorinated lubricants.

12 Claims, No Drawings

LUBRICATING COMPOSITIONS

CROSS-REFERENCE TO RELATED APPLICATIONS

This patent application is a national stage entry of PCT/EP2022/080493 filed on 2 Nov. 2022, which claims priorities filed on 3 Nov. 2021 in UNITED STATES with No. 63/275,025 and filed on 18 Nov. 2021 in EUROPE with Nr. 21209038.5, the whole content of each of these applications being incorporated herein by reference for all purposes.

TECHNICAL FIELD

The present patent application relates to the use of aromatic polymers as additives for lubricants.

BACKGROUND ART

It is known that certain hydrogen-based lubricants of natural or synthetic origin, in particular certain lubricant oils, are endowed with remarkable lubricant properties and are available on the market at reasonable costs. Examples of hydrogen-based lubricant oils comprise mineral oils of hydrocarbon type, animal and vegetal hydrogenated oils, synthetic hydrogenated oils including polyalphaolefins (PAOs), dibasic acid esters, polyol esters, phosphate esters, polyesters, alkylated naphthalenes, polyphenyl ethers, polybutenes, multiply-alkylated cyclopentanes, silane hydrocarbons, siloxanes and polyalkylene glycols.

A possible alternative to hydrogen-based lubricants is represented by (per)fluoropolyether (PFPE) lubricants, i.e. lubricants comprising a perfluorooxyalkylene chain, that is to say a chain comprising recurring units having at least one ether bond and at least one fluorocarbon moiety. PFPE lubricants are endowed with high thermal and chemical resistance, so they are useful in cases of applications characterised by harsh conditions (very high temperatures, presence of oxygen, use of aggressive chemicals and radiations, etc.). However, PFPE oils are more expensive than hydrogenated oils and hence they are used only when high performances are requested.

To operate at high temperature, the thickening additive should have excellent thermal and chemical stability. In addition, fluorinated oils and greases suffer degradative processes at high temperatures in the presence of metals and in an oxidising environment, which break the backbone chains producing volatile products. This leads to the loss of the lubricating performances of both oils and greases.

To overcome this drawback, it is known from the prior art to use additives that stabilise the oils and greases at high temperatures in an oxidising environment and in the presence of metals, thus guaranteeing their stability during the use.

Liquid stabilising additives were disclosed in the prior art. However, for applications wherein a continued use at high temperatures, higher than 200° C., is required, it is necessary to increase the additive amount, generally to values higher than about 5% by weight over the total weight of the oil or grease. The drawback of using liquid stabilising additives in high amounts in the preparation of greases resides in that the ratios between the liquid component of the grease (the oil plus additive) and the solid component of the grease (the thickener) are changed. High amounts of the liquid causes an increase of the liquid separation from the solid as the temperature increases, thus changing the initial grease consistency. The oil separation becomes significant at temperatures higher than 200° C. Furthermore, as the working temperatures increase, the liquid additives tend to evaporate more easily.

The use of polymers that are solid at room temperature and have a melting point higher than 150° C., was disclosed for example in WO 2007/082829 (Solvay Solexis S.p.A.). This patent application discloses the use of polymers containing at least one aromatic ring in their backbone as additives to stabilise perfluoropolyether oils. The compositions disclosed in this patent application comprised aromatic polymer powder having an average size preferably between 0.1 μm and 1,000 μm. Preferred embodiment comprised, in addition to said aromatic polymer powder, PTFE powder.

SUMMARY OF INVENTION

The Applicant perceived that on the one hand, it is no longer desired to use PTFE powder for environmental reasons. On the other hand, the Applicant noted that the performances of such aromatic polymer powder are no longer suitable to meet the ever increasing requirements of specialty industries.

Facing such challenges, the Applicant developed new compositions having excellent thermal stability at high temperatures in an oxidising environment, in particular at temperatures higher than 200° C.

More in particular, the Applicant developed a powder of aromatic polymers characterised by a specific particle size and surface area, capable of stabilising hydrogenated oils, at high temperatures in an oxidising environment, and also fluorinated oils even in the presence of metals, at high temperatures, even higher than 200° C.

DESCRIPTION OF EMBODIMENTS

For the purpose of the present description and of the following claims:

the use of parentheses around symbols or numbers identifying the formulae, for example in expressions like "polymer (P)", etc., has the mere purpose of better distinguishing the symbol or number from the rest of the text and, hence, said parenthesis can also be omitted.

Thus, in a first aspect, the present invention relates to a composition comprising:

(A) from 99.9% to 65.0% by weight, from 99.0% to 68.0% by weight based on 100% by weight of said composition, of at least one hydrogenated or (per) fluorinated oil, and (B) from 0.1% to 35.0% by weight, preferably from 1.0% to 32.0% by weight, based on 100% by weight of said composition, of at least one aromatic polymer:
having a melting point of at least 150° C. and
being in the form of powder having an average particle size ($d_{50}$) measured by laser diffraction particle size analysis as volume particle size distribution, in the range from above 1 micrometer and up to 15 micrometers, and a surface area (determined by gas adsorption using the BET method according to ISO 9277) from 0.5 to less than 5 $m^2/g$.

Preferably, the aromatic polymer is in the form of powder having a $d_{50}$ higher than 1 micrometer, more preferably higher than 2 micrometers, and still more preferably higher than 3 micrometers, as measured by laser diffraction particle size analysis as volume particle size distribution.

Preferably, the aromatic polymer is in the form of powder having a $d_{50}$ below 15 micrometers, more preferably below 12 micrometers, and still more preferably below 10 micrometers, as measured by laser diffraction particle size analysis as volume particle size distribution.

Preferably, said at least one hydrogenated oil is a mineral oil or a synthetic oil, such as polyalphaolefins (PAO) and polyalkylene glycol (PAG); esters; silicon oils; polyphenyl ethers; and the like.

Preferably, said at least one (per) fluorinated oil is a (per) fluoropolyether (PFPE) polymer.

Preferably, said PFPE polymer comprises a partially or fully fluorinated chain [chain (Rf)] comprising, preferably consists of, repeating units R°, said repeating units being independently selected from the group consisting of:

(i) —CFXO—, wherein X is F or $CF_3$;

(ii) —CFXCFXO—, wherein X, equal or different at each occurrence, is F or $CF_3$, with the proviso that at least one of X is —F;

(iii) —$CF_2CF_2CW_2O$—, wherein each of W, equal or different from each other, are F, Cl, H;

(iv) —$CF_2CF_2CF_2CF_2O$—;

(v) —$(CF_2)_j$—CFZ—O— wherein j is an integer from 0 to 3 and Z is a group of general formula —O—$R_{(f\text{-}a)}$-T, wherein $R_{(f\text{-}a)}$ is a fluoropolyoxyalkene chain comprising a number of repeating units from 0 to 10, said recurring units being chosen among the following: —CFXO—, —$CF_2CFXO$—, —$CF_2CF_2CF_2O$—, —$CF_2CF_2CF_2CF_2O$—, with each of X being independently F or $CF_3$ and T being a $C_1$-$C_3$ perfluoroalkyl group.

Preferably, chain ($R_f$) complies with the following formula:

$$—[(CFX^1O)_{g1}(CFX^2CFX^3O)_{g2}(CF_2CF_2CF_2O)_{g3}(CF_2CF_2CF_2CF_2O)_{g4}]— \quad (R_f\text{-I})$$

wherein $X^1$ is independently selected from —F and —$CF_3$, $X^2$, $X^3$, equal or different from each other and at each occurrence, are independently —F, —$CF_3$, with the proviso that at least one of X is —F;

g1, g2, g3, and g4, equal or different from each other, are independently integers ≥0, such that g1+g2+g3+g4 is in the range from 2 to 300, preferably from 2 to 100; should at least two of g1, g2, g3 and g4 be different from zero, the different recurring units are generally statistically distributed along the chain.

More preferably, chain ($R_f$) is selected from chains of formula:

$$—[(CF_2CF_2O)_{a1}(CF_2O)_{a2}]— \quad (R_f\text{-IIA})$$

wherein:

a1 and a2 are independently integers ≥0 such that the number average molecular weight is between 400 and 10,000, preferably between 400 and 5,000; both a1 and a2 are preferably different from zero, with the ratio a1/a2 being preferably comprised between 0.1 and 10;

$$—[(CF_2CF_2O)_{b1}(CF_2O)_{b2}(CF(CF_3)O)_{b3}(CF_2CF(CF_3)O)_{b4}]— \quad (R_f\text{-IIB})$$

wherein:

b1, b2, b3, b4, are independently integers ≥0 such that the number average molecular weight is between 400 and 10,000, preferably between 400 and 5,000; preferably b1 is 0, b2, b3, b4 are >0, with the ratio b4/(b2+b3) being ≥1;

$$—[(CF_2CF_2O)_{c1}(CF_2O)_{c2}(CF_2(CF_2)_{cw}CF_2O)_{c3}]— \quad (R_f\text{-IIC})$$

wherein:

cw=1 or 2;

c1, c2, and c3 are independently integers ≥0 chosen so that the number average molecular weight is between 400 and 10,000, preferably between 400 and 5,000; preferably c1, c2 and c3 are all >0, with the ratio c3/(c1+c2) being generally lower than 0.2.

Still more preferably, chain ($R_f$) complies with formula ($R_f$-III) here below:

$$—[(CF_2CF_2O)_{a1}(CF_2O)_{a2}]— \quad (R^f\text{-III})$$

wherein:

a1, and a2 are integers >0 such that the number average molecular weight is between 400 and 10,000, preferably between 400 and 5,000, with the ratio a1/a2 being generally comprised between 0.1 and 10, more preferably between 0.2 and 5.

Said at least one aromatic polymer is advantageously selected in the group comprising, preferably consisting of:

(a) poly(arylene sulphides) (PAS) polymer;

(b) poly(phenylene oxides) (PPO) polymer;

(c) poly(aryl ether ketone) (PAEK) polymer; and (d) poly(aryl ether sulfone) (PAES) polymer.

Preferably, said (a) poly(arylene sulfide) (PAS) is a polymer comprising —(Ar—S)— recurring units, wherein Ar is an arylene group, also called herein recurring unit (RPAs).

The arylene groups of the PAS can be substituted or unsubstituted.

Additionally, said PAS can include any isomeric relationship of the sulfide linkages in polymer; e.g., when the arylene group is a phenylene group, the sulfide linkages can be ortho, meta, para, or combinations thereof.

Preferably, said PAS polymer comprises at least 5, at least 10, at least 20, at least 30, at least 40, at least 50, at least 60, at least 70, at least 80, at least 90, at least 95, at least 98 mol. % of recurring units (RPAs), based on the total number of males in the PAS. According to an embodiment, the PAS consists essentially in recurring units (RPAs).

Preferably, said PAS polymer is selected from the group consisting of poly(2,4-toluene sulfide), poly(4,4'-biphenylene sulfide), poly(para-phenylene sulfide) (PPS), poly (ortho-phenylene sulfide), poly(meta-phenylene sulfide), poly(xylene sulfide), poly(ethylisopropylphenylene sulfide), poly(tetramethylphenylene sulfide), poly(butylcyclohexylphenylene sulfide), poly(hexyldodecylphenylene sulfide), poly(octadecylphenylene sulfide), poly(phenylphenylene sulfide), poly-(tolylphenylene sulfide), poly(benzylphenylene sulfide) and poly [octyl-4-(3-methylcyclopentyl)phenylene sulfide].

More preferably, said PAS is a PPS comprising recurring units represented by Formula I:

(I)

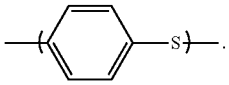

Even more preferably, the PPS comprises at least 50 mol. % of recurring units of Formula I, based on the total number of moles in the PPS polymer. For example at least about 60 mol. %, at least about 70 mol. %, at least about 80 mol. %, at least about 90 mol. %, at least about 95 mol. %, at least about 99 mol. % of the recurring units in the PPS are recurring units of Formula I.

According to an embodiment of the present invention, the PPS polymer is such that about 100 mol. % of the recurring units are recurring units of Formula I. According to this embodiment, the PPS polymer consists essentially of recurring units (RPPs) of Formula I.

The PAS polymer of the present invention can be obtained by a process known in the art. Reference can notably be made to WO 2015/095362 A1 (Chevron Philipps), WO 2015/177857 A1 (Solvay) and WO 2016/079243 A1 (Solvay).

Preferably, said (b) poly(phenylene oxide) (PPO) polymer comprises recurring units complying with the following formulae (II):

(II)

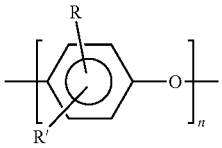

wherein

R and R', equal to or different from each other, are H, —$CH_3$ or —$C_6H_5$ and n is an integer at least equal to 1.

Preferably, said (c) poly(aryl ether ketone) (PAEK) polymer is a polymer comprising more than 50 mol % of recurring units (R-PAEK), wherein recurring units (R-PAEK) comprise a Ar—C(O)—Ar'roup, wherein Ar and Ar', equal to or different from each other, are aromatic groups.

In some embodiments, the poly(aryl ether ketone) (PAEK) comprises at least 60 mol. %, at least 70 mol. %, at least 80 mol. %, at least 90 mol. %, at least 95 mol. %, or at least 99 mol. %, at least 99.5 mol %, or at least 99.9 mol % of recurring units (R-PAEK). As used herein, mol. % is relative to the total number of moles of recurring units in the poly(aryl ether ketone) (PAE K).

In some embodiments, the recurring units (R-PAEK) are selected from the group consisting of formulae (J-A) to (J-O), herein below:

(J-A)

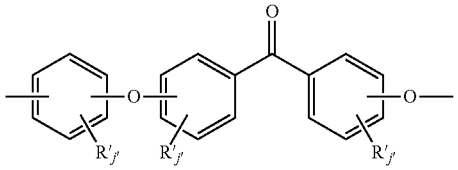

(J-B)

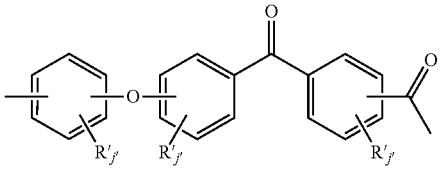

(J-C)

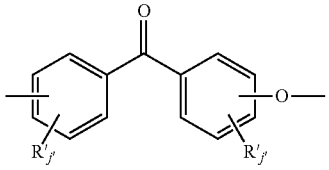

(J-D)

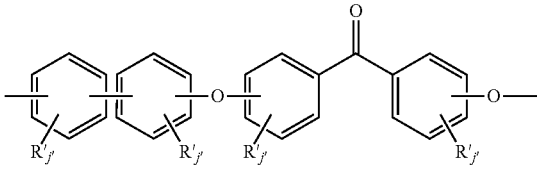

(J-E)

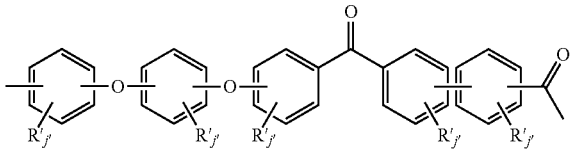

(J-F)

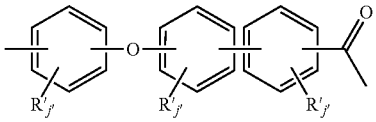

(J-G)

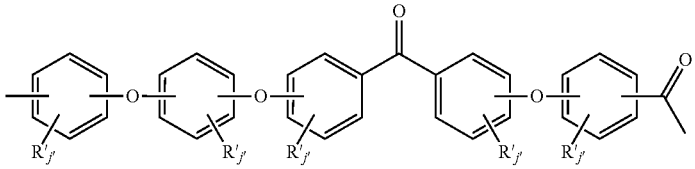

(J-H)

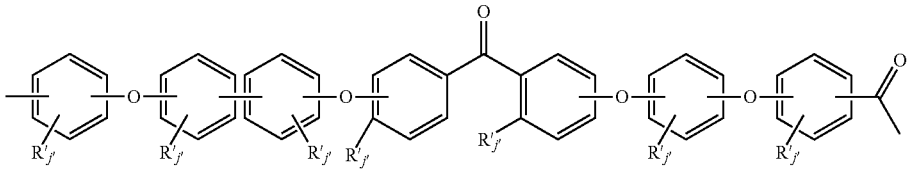

(J-I)

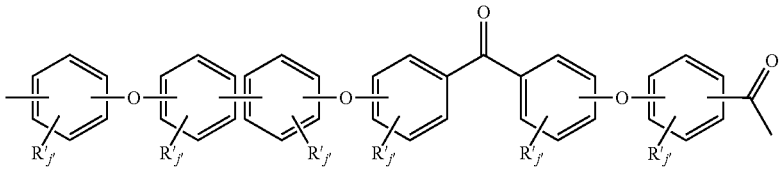

-continued (J-J)

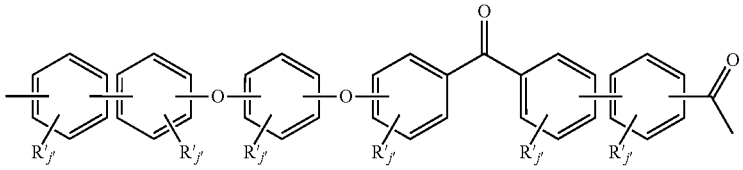

(J-K)

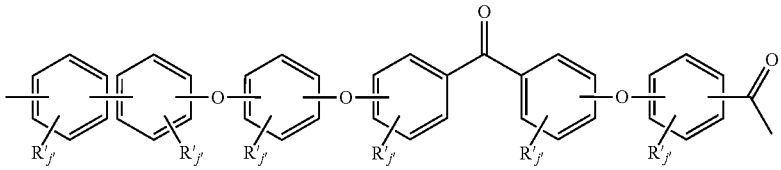

(J-L)

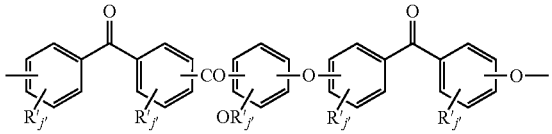

(J-M)

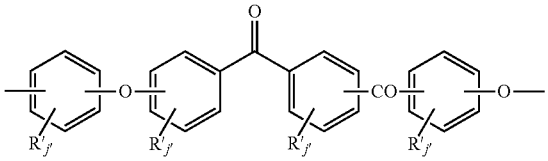

(J-N)

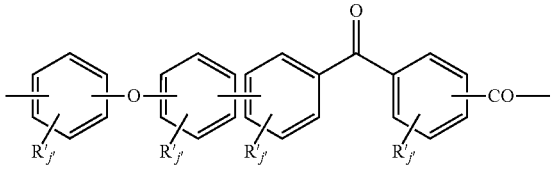

(J-O)

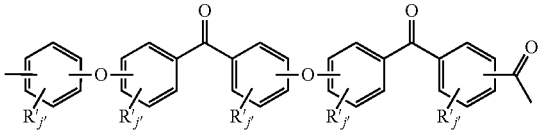

wherein:

each of R', equal to or different from each other, is selected from the group consisting of halogen, alkyl, alkenyl, alkynyl, aryl, ether, thioether, carboxylic acid, ester, amide, imide, alkali or alkaline earth metal sulfonate, alkyl sulfonate, alkali or alkaline earth metal phosphonate, alkyl phosphonate, amine and quaternary ammonium; and j's an integer from 0 to 4.

In the recurring unit (R-PAEK), the respective phenylene moieties may independently have 1,2-, 1,4- or 1,3-linkages to the other moieties different from R'n the recurring unit. Preferably, the phenylene moieties have 1,3- or 1,4-linkages, more preferably they have 1,4-linkage.

In some embodiments, j'n recurring unit (R-PAEK) is at each occurrence zero. That is to say that the phenylene moieties have no other substituents than those enabling linkage in the main chain of the polymer.

Preferred recurring units (RPAEK) are thus selected from those of formulae (J'-A) to (J'-0) herein below.

(J'-A)

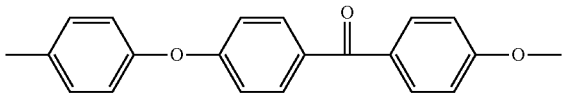

(J'-B)

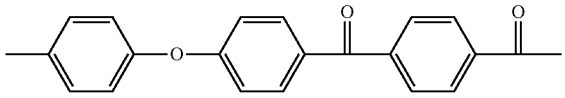

(J'-C)

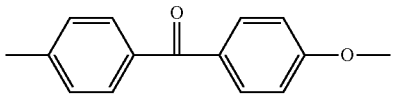

(J'-D)

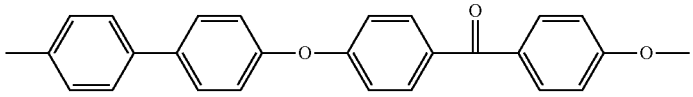

-continued (J'-E)

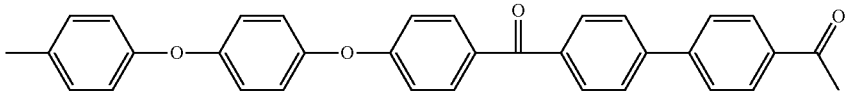

(J'-F)

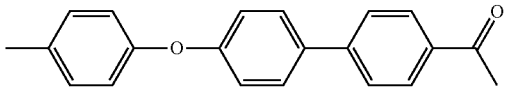

(J'-G)

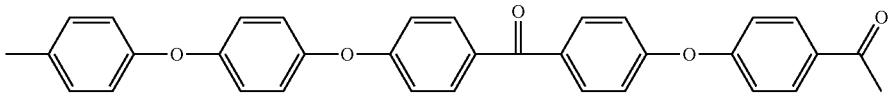

(J'-H)

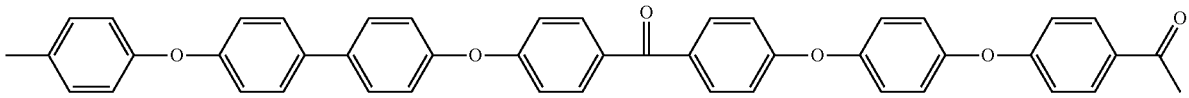

(J'-I)

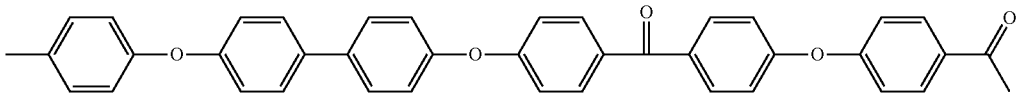

(J'-J)

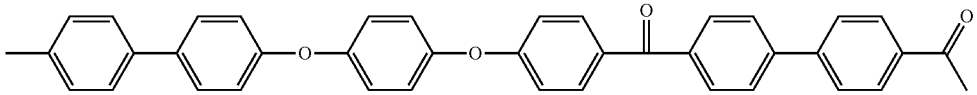

(J'-K)

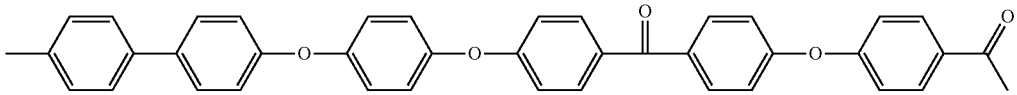

(J'-L)

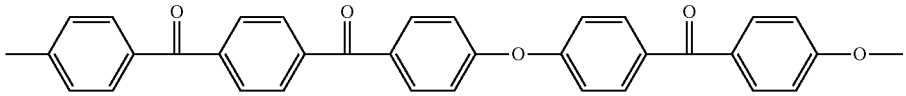

(J'-M)

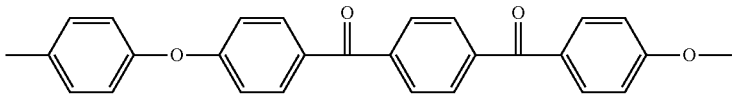

(J'-N)

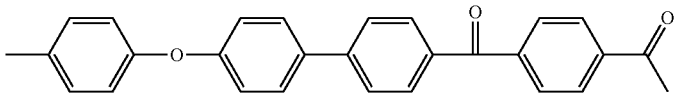

(J'-O)

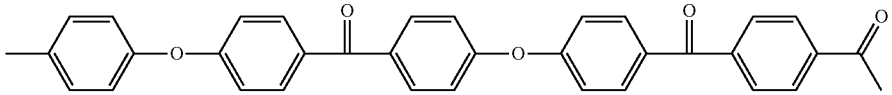

In a preferred embodiment, the polyaryletherketone (PAEK) is a polyetheretherketone (PEEK).

In this embodiment, the polyetheretherketone (PEEK) has recurring units (R-PEEK) represented by either formula (J-A) or (J'-A), preferably recurring unit (R-PEEK) is represented by formula (J'-A).

According to an embodiment, the composition (C) comprises a plurality of distinct poly(aryl ether ketone) polymers, each poly(aryl ether ketone) polymer having a distinct recurring unit (R-PAEK).

Preferably, in said (d) poly(aryl ether sulfone) (PAES) polymer, at least 50 mol. % of the recurring units are recurring units of formula (IV):

(IV)

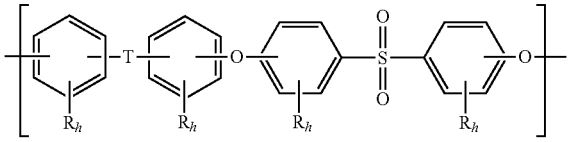

wherein:

(i) each R, equal to or different from each other, is selected from a halogen, an alkyl, an alkenyl, an alkynyl, an aryl, an ether, a thioether, a carboxylic acid, an ester, an amide, an imide, an alkali or alkaline earth metal sulfonate, an alkyl sulfonate, an alkali or alkaline earth metal phosphonate, an alkyl phosphonate, an amine, and a quaternary ammonium;

(ii) each h, equal to or different from each other, is an integer ranging from 0 to 4; and (iii) T is selected from the group consisting of a bond, a sulfone group [—S(=O)2-], and a group —C(Rj)(Rk)-, where Rj and Rk, equal to or different from each other, are selected from a hydrogen, a halogen, an alkyl, an alkenyl, an alkynyl, an ether, a thioether, a carboxylic acid, an ester, an amide, an imide, an alkali or alkaline earth metal sulfonate, an alkyl sulfonate, an alkali or alkaline earth metal phosphonate, an alkyl phosphonate, an amine, and a quaternary ammonium.

Rj and Rk are preferably methyl groups.

Preferably at least 60 mol. %, 70 mol. %, 80 mol. %, 90 mol. %, 95 mol. %, 99 mol. %, and most preferably all of recurring units in the poly(aryl ether sulfone) (PAES) are recurring units of formula (IV). As used herein, mol. % is relative to the total number of moles of recurring units in the poly(aryl ether sulfone) (PAES).

In an embodiment, the poly(aryl ether sulfone) (PAES) is a poly(biphenyl ether sulfone). A poly(biphenyl ether sulfone) polymer is a poly(aryl ether sufone) which comprises a biphenyl moiety. The poly(biphenyl ether sulfone) is also known as polyphenyl sulfone (PPSU) and for example results from the condensation of 4,4'-dihydroxybiphenyl (biphenol) and 4,4'-dichlorodiphenyl sulfone.

As used herein, a "poly(biphenyl ether sulfone) (PPSU)" denotes any polymer of which more than 50 mol. % of the recurring units are recurring units (Rppsu) of formula (IV-A):

(IV-A)

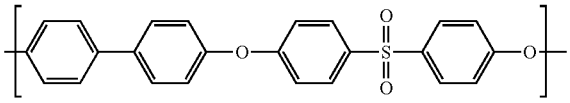

Preferably at least 60 mol. %, 70 mol. %, 80 mol. %, 90 mol. %, 95 mol. %, 99 mol. %, and most preferably all of the recurring units in the poly(biphenyl ether sulfone) (PPSU) are recurring units of formula (IV-A).

In an embodiment, the poly(aryl ether sulfone) (PAES) is a polyethersulfone (PES).

As used herein, a "poly(ethersulfone) (PES)" denotes any polymer of which at least 50 mol. % of the recurring units are recurring units of formula (IV-B):

(IV-B)

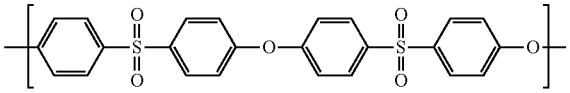

Preferably at least 60 mol. %, 70 mol. %, 80 mol. %, 90 mol. %, 95 mol. %, 99 mol. %, and most preferably all of the recurring units in the poly(ethersulfone) (PES) are recurring units of formula (IV-B).

In an embodiment, the poly(aryl ether sulfone) (PAES) is a polysulfone (PSU). As used herein, a "polysulfone (PSU)" denotes any polymer of which at least 50 mol. % of the recurring units are recurring units of formula (IV-C):

(IV-C)

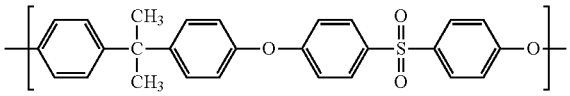

Preferably at least 60 mol. %, 70 mol. %, 80 mol. %, 90 mol. %, 95 mol. %, 99 mol. %, and most preferably all of the recurring units in the PSU are recurring units of formula (IV-C).

The composition of the invention can comprise further additives, if required by the final use, such as for example those commonly used in lubricant compositions. Non-limiting examples of suitable additives are the following: anti-rust agents, antioxidants, thermal stabilizers, pour-point depressants, anti-wear agents, including those for high pressures, tracers, dyestuffs and fillers.

However, the composition of the present invention is advantageously free from PTFE as the filler and/or from dispersants such as, surfactants, in particular non-ionic surfactants.

The composition of the present invention can be prepared according to methods known in the art, depending on the final use for which said composition is intended.

The composition of the present invention is ready to use or can be added to another oil/grease composition.

Should the disclosure of any patents, patent applications, and publications which are incorporated herein by reference conflict with the description of the present application to the extent that it may render a term unclear, the present description shall take precedence The invention will now be described with reference to the following examples, whose purpose is merely illustrative and not intended to limit the scope of the invention.

EXPERIMENTAL SECTION

Materials

PPS-1: $d_{50}$=2.5 μm; surface area=1.3 $m^2/g$

PPS-2: $d_{50}$=6.0 μm; surface area=1.7 $m^2/g$

Blend PPS-2/Algoflon® PTFE L203 50/50 wt. %

PEEK-1 (polyetheretherketone): $d_{50}$=10.0 μm; surface area=1.7 $m^2/g$

Base Oils:

Fomblin® M30 PFPE was obtained from Solvay Specialty Polymers Italy, S.p.A.

Priolube™ 3970 (nC8/nC10 polyol ester) was provided by Croda industrial

Chemicals Synfluid® mPAO 40 cSt was provided by Chevrons Phillips Chemicals

The following were used as comparison:

Algoflon® L206 and Algoflon® L203-PTFE (polytetrafluoroethylene) ($d_{50}$=5 μm for both polymers; surface area=7.5 $m^2/g$ and 10.0 $m^2/g$, respectively) were obtained from Solvay Specialty Polymers Italy, S.p.A.

PPS manufactured according to the method disclosed in WO 2007/082829, cited in the background section, hereinafter referred to as "PPS-2007" ($d_{50}$=30-35 μm; surface area=1.45 $m^2/g$).

Methods:

Particle size distribution was measured by laser diffraction particle size analysis.

Specific surface area of the powder was determined by gas adsorption using the BET method (ISO 9277).

PREPARATIVE EXAMPLE

The greases were prepared by mixing the base oil with at least one polymer in the form of powder, using a high shear lab mixing (Silverson 1L). If needed the grease was then further homogenised in a 3-roll refiner.

Example Set A-Base Oil=Fomblin® M30 PFPE

Example A-1

For each composition, the concentration of the polymer in Fomblin® M30 PFPE was increased until a grease consistency NLGI equal to 2, according to ASTM D217-10 (range of grease penetration at 25° C. equal to 265-295 mm in 10 minutes) was obtained.

The compositions and their properties are summarised in Table 1.

TABLE 1

| Composition No. | Thickener | Thickener Concentration (wt. %) | Consistency NLGI Class |
|---|---|---|---|
| 1 | PPS-1 | 27.0 | 2 |
| 2 | PPS-2 | 30.0 | 2 |
| 3 | Blend PPS-2/ Algoflon ® L203 | 32.5 | 2 |
| 4 | PEEK-1 | 30.0 | 2 |
| 5(*C) | Algoflon ® L206 | 30.0 | 2 |
| 6(*C) | PPS-2007 | 31.0 | 2 |

(*C) = of comparison

The powders according to the present invention showed good thickening properties. The results were indeed similar to those obtained for composition 5 (*C), which to date is the benchmark for such evaluation.

Example A-2

For each composition, the oil separation was determined according to ASTM D6184 at 204° C. per 30 hours.

The results are summarised in Table 2.

| Composition No. | Oil separation (wt. %) |
|---|---|
| 1 | 6.4 |
| 3 | 5.8 |
| 5(*C) | 10.7 |
| 6(*C) | 10.8 |

(*C) = comparison

Example A-3

For each composition, the torque at low temperature was evaluated according to ASTM D1478 in all bearing SKF 6204 at a rotation speed=1 rpm for 1 h and at a temperature equal to −40° C.

The results are summarised in Table 3.

TABLE 3

| Composition No. | Starting torque (g · cm) | Running torque (g · cm) |
|---|---|---|
| 1 | 2306 | 513 |
| 2 | 3109 | 1424 |
| 3 | 1009 | 422 |
| 4 | 2443 | 773 |
| 5(*C) | 800 | 300 |
| 6(*C) | 8289 | 1368 |

(*C) = comparison

The compositions of the invention showed lower starting torque than the comparative composition 6 (*C), which indicates better performance at low temperature.

Example A-4

Friction and Wear tests were performed according to ASTM D5707: the Standard test method for measuring friction and wear properties of lubricating greases using a high-frequency, linear-oscillation (SRV) test machine.

The test was performed with the following conditions:

Geometry: ball (Ø=10 mm) on disk (material 100 Cr 6);

Pre-load 50N for 30 sec;

Load 200N for 2 hours;

Stroke 1 mm;

Frequency 50 Hz;

Temperature: 180° C.

The results are summarised in Table 4.

TABLE 4

| Composition No. | COF end | Wear scar (mm) |
|---|---|---|
| 1 | 0.20 | 1.11 |
| 2 | 0.19 | 1.07 |
| 3 | 0.18 | 1.41 |
| 4 | 0.23 | 1.43 |
| 5(*C) | 0.19 | 1.30 |

(*C) = comparison
COF = Coefficient of Friction

The compositions according to the invention showed a low coefficient of friction and only a little wear scar was generated on the ball.

Example A-5

Thermo-oxidative test was performed with a TGA analysis in air placing the grease sample in an aluminium cap, so that the grease was in contact with an electropositive metal. The sample was heated up to 300° C. followed by 30 min ramps in isotherm from 300° C. to 500° C. with 10° C. temperature jumps.

TABLE 5

| Composition No. | 50% weight loss |
|---|---|
| 1 | 500° C. |
| 4 | 500° C. |
| 5(*C) | 330° C. |

(*C) = comparison

The thermo-oxidative stability of the compositions of the invention was higher than the stability of the comparative composition.

Example Set B-Base Oil=Priolube™ 3970

Example B-1

The test was performed as disclosed in Example A-1. The results are summarised in Table 6.

TABLE 6

| Composition No. | Thickener | Thickener Concentration (wt. %) | Consistency NLGI Class |
|---|---|---|---|
| 10 | PPS-2 | 57.0 | 2 |
| 11 | PPS-2 | 55.0 | 1/2 |
| 12(*C) | Algoflon ® L206 | 37.5 | 2 |

(*C) = comparison

Example B-2

The test was performed as disclosed in Example A-2, but at a temperature of 120° C. for 30 hours.

The results are summarised in Table 7.

TABLE 7

| Composition No. | Oil separation (wt. %) |
|---|---|
| 11 | 1.52 |
| 12(*C) | 3.54 |

(*C) = comparison

The above results showed that the composition according to the present invention is more stable than the comparative composition.

Example Set C-Base Oil=Synfluid® mPAO 40 cSt

Example C-1

The test was performed as disclosed in Example A-1. The results are summarised in Table 8.

TABLE 8

| Composition No. | Thickener | Thickener Concentration (wt. %) | Consistency NLGI Class |
|---|---|---|---|
| 20 | PPS-2 | 57.0 | 2 |
| 21 | PPS-2 | 53.0 | 1/2 |
| 22(*C) | Algoflon ® L203 | 33.3 | 2 |

(*C) = comparison

Example C-2

The test was performed as disclosed in Example A-2, but at a temperature of 120° C. for 30 hours.

The results are summarised in Table 9.

TABLE 9

| Composition No. | Oil separation (wt. %) |
|---|---|
| 20 | 0.27 |
| 22(*C) | 2.75 |

(*C) = comparison

The above results showed that the composition according to the present invention is more stable than the comparative composition.

The invention claimed is:

1. A composition comprising:

(A) from 99.9% to 65.0% by weight, based on 100% by weight of said composition, of at least one hydrogenated or (per) fluorinated oil, and (B) from 0.1% to 35.0% by weight, based on 100% by weight of said composition, of at least one aromatic polymer:

having a melting point of at least 150° C. and being in the form of powder having an average particle size ($d_{50}$) in the range from above 1 micrometer and up to 15 micrometers, as measured by laser diffraction particle size analysis as volume particle size distribution, and a surface area from 0.5 to less than 5 $m^2/g$, as determined by gas adsorption using the BET method according to ISO 9277, wherein said at least one aromatic polymer is selected from the group consisting of:

(a) poly(arylene sulphides) (PAS) polymer;

(b) poly(phenylene oxides) (PPO) polymer;

(c) poly(aryl ether ketone) (PAEK) polymer; and (d) poly(aryl ether sulfone) (PAES) polymer.

2. The composition according to claim 1, wherein said composition contains:

(A) from 99% to 68.0% by weight, based on 100% by weight of said composition, of at least one hydrogenated or (per) fluorinated oil, and (B) from 1.0% to 32.0% by weight, based on 100% by weight of said composition, of at least one aromatic polymer.

3. The composition according to claim 1 wherein said at least one hydrogenated oil is a mineral oil or a synthetic oil.

4. The composition according to claim 1, wherein said at least one (per) fluorinated oil is a (per) fluoropolyether (PFPE) polymer.

5. The composition according to claim 4, wherein said PFPE polymer comprises a partially or fully fluorinated chain [chain (Rf)] comprising, repeating units R, said repeating units being independently selected from the group consisting of:

(i) —CFXO—, wherein X is F or $CF_3$;

(ii) —CFXCFXO—, wherein X, equal or different at each occurrence, is F or $CF_3$, with the proviso that at least one of X is —F;

(iii) —$CF_2CF_2CW_2O$—, wherein each of W, equal or different from each other, are F, Cl, H;

(iv) —$CF_2CF_2CF_2CF_2O$—;

(v) —$(CF_2)_j$—CFZ—O— wherein j is an integer from 0 to 3 and Z is a group of general formula —O—$R_{(f-a)}$-T, wherein $R_{(f-a)}$ is a fluoropolyoxyalkene chain comprising a number of repeating units from 0 to 10, said recurring units being chosen among the following: —CFXO—, —$CF_2CFXO$—, —$CF_2CF_2CF_2O$—, —$CF_2CF_2CF_2CF_2O$—, with each of X being independently F or $CF_3$ and T being a $C_1$-$C_3$ perfluoroalkyl group.

6. The composition according to claim 1, wherein said (a) poly(arylene sulphides) (PAS) polymer comprises recurring units:

—(Ar—S)— (RPAs)

wherein Ar is an arylene group.

7. The composition according to claim 1, wherein said (b) poly(phenylene oxide) (PPO) polymer comprises recurring units complying with the following formulae (II):

(II)

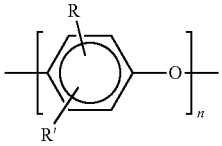

wherein

R and R', equal to or different from each other, are H, —$CH_3$ or —$C_6H_5$ and n is an integer at least equal to 1.

8. The composition according to claim 1, wherein said (c) poly(aryl ether ketone) (PAEK) polymer comprises more than 50 mol % of recurring units comprising a group:

Ar—C(O)—Ar' (R-PAEK)

wherein Ar and Ar', equal to or different from each other, are aromatic groups.

9. The composition according to claim 1, wherein said (d) poly(aryl ether sulfone) (PAES) polymer comprises at least 50 mol. % of the recurring units are recurring units of formula (IV):

(IV)

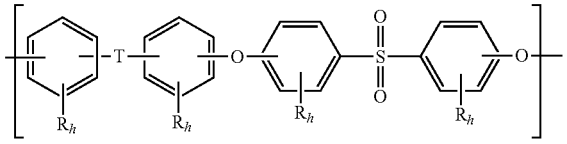

wherein:

(i) each R, equal to or different from each other, is selected from a halogen, an alkyl, an alkenyl, an alkynyl, an aryl, an ether, a thioether, a carboxylic acid, an ester, an amide, an imide, an alkali or alkaline earth metal sulfonate, an alkyl sulfonate, an alkali or alkaline earth metal phosphonate, an alkyl phosphonate, an amine, and a quaternary ammonium;

(ii) each h, equal to or different from each other, is an integer ranging from 0 to 4; and (iii) T is selected from the group consisting of a bond, a sulfone group [—S(=O)2-], and a group —C(Rj)(Rk)-, where Rj and Rk, equal to or different from each other, are selected from a hydrogen, a halogen, an alkyl, an alkenyl, an alkynyl, an ether, a thioether, a carboxylic acid, an ester, an amide, an imide, an alkali or alkaline earth metal sulfonate, an alkyl sulfonate, an alkali or alkaline earth metal phosphonate, an alkyl phosphonate, an amine, and a quaternary ammonium.

10. The composition according to claim 1, wherein said composition further comprises at least one additional additive selected in the group consisting of: antirust agents, antioxidants, thermal stabilizers, pour-point depressants, anti-wear agents, tracers, dyestuffs and fillers.

11. The composition according to claim 1, wherein said composition is free from poly(tetra fluoro ethylene) (PTFE).

12. The composition according to claim 1, wherein said composition is free from dispersants and/or surfactants.

* * * * *